United States Patent [19]

Kobryn

[11] 4,423,969

[45] Jan. 3, 1984

[54] PRINT HEAD

[75] Inventor: Ronald J. Kobryn, Longwood, Fla.

[73] Assignee: Presicion Handling Devices, Inc., Assonet, Mass.

[21] Appl. No.: 337,240

[22] Filed: Jan. 6, 1982

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,893,220 | 7/1975 | Bittner | 400/124 X |
| 3,929,214 | 12/1975 | Hebert | 400/124 |
| 3,994,381 | 11/1976 | Hebert | 400/124 |
| 4,004,673 | 1/1977 | Burzlaff et al. | 400/124 |
| 4,049,107 | 9/1977 | Murat | 400/124 |
| 4,051,941 | 9/1977 | Hebert | 400/124 |
| 4,060,161 | 11/1977 | Nelson et al. | 400/124 |
| 4,140,406 | 2/1979 | Wolf et al. | 400/124 |
| 4,197,021 | 4/1980 | Gomi et al. | 400/124 |
| 4,204,778 | 5/1980 | Miyazawa et al. | 400/124 |
| 4,240,756 | 12/1980 | Ku et al. | 400/124 |
| 4,244,658 | 1/1981 | Mori | 400/124 |
| 4,279,518 | 7/1981 | Blomquist et al. | 400/124 |
| 4,335,969 | 6/1982 | Ott | 400/124 |

*Primary Examiner*—Paul T. Sewell
*Attorney, Agent, or Firm*—Martin LuKacher

[57] ABSTRACT

An impact dot matrix print head has a body with a coil frame assembly and a nose piece on the rear of which the coil frame assembly is mounted. The nose piece has guides for print wires which are maintained in sliding relationship by a linear slot guide at the front end of the nose piece. Armatures are freely disposed at one end on the frame and at the other end on the rear ends of the print wires. An end cap which bears on the frame assembly has a plurality of posts which extend through holes in each of the armatures and holes in spider springs which bear against the end cap and against the armatures where they bear against and pivot on the frame whereby to provide for ease of assembly and low friction guidance of the armatures and the spider springs which retain them. These springs may also be located with respect to the pivot so that they oppose the force of return springs on the print wires and partially balance such force to improve magnetic actuation of the armatures to help increase the printing speed of the head. Another end cap at the front of the frame assembly and the rear end cap are joined together by press fitting into posts to clamp the frame assembly into assembled relationship. A printed circuit board to which the coils are connected may be attached to the outside of the front end cap facing the front end of the nose piece.

24 Claims, 6 Drawing Figures

PRINT HEAD

DESCRIPTION

The present invention relates to print heads and particularly to impact dot matrix print heads of the ballistic type.

The invention is especially suitable for providing a print head which may be useful generally in various different designs of dot matrix printers. The print head is also applicable to printers which are uniquely designed to incorporate it as a part thereof.

There are many ostensibly conflicting requirements for dot matrix print heads which make the design thereof especially difficult. There have been, of course, many attempts to meet these requirements but most have resulted in tradeoffs such that the requirements have not been fully realized. These requirements are quality printing, as near to letter quality as possible; low costs; high speed (character per second) operation; thermal efficiency and cool running; reliability; compact construction; and adaptability to many printer designs. Some print heads have attempted to meet the requirements by the use of special armature constructions and retainers for the armatures; for example, having notches or notched springs in which the armatures are seated (see U.S. Pat. Nos. 4,049,107 issued Sept. 20, 1977 and 4,244,658 issued Jan. 13, 1981). Special compound armature and spring assemblies have also been suggested, (see U.S. Pat. Nos. 4,197,021 issued Apr. 8, 1980 and 4,204,778 issued May 27, 1980). Special attention has been placed on minimizing the air gap in the magnetic actuating structure of the armatures. This has involved adjustment and alignment devices which are costly to install and require costly labor time to adjust (se U.S. Pat. Nos. 4,004,673 issued Jan. 25, 1977 and 3,994,381 issued Nov. 30, 1976. Sometimes compound armatures with extra magnetic structure to minimize the air gap have been proposed as in the above-mentioned U.S. Pat. Nos. 4,197,021, 4,204,778 and 4,244,658. The guidance of the print wires and the translation thereof from a generally circular array at the driving points near the rear thereof to a linear array at the front of the print head where they impact the ribbon and/or the paper has resulted in problems which have prevented the requirements from being achieved. For example: jewel bearings in the guides have been used, which contributes to the cost of the head, and special nose pieces to minimize spreading of the wires (see U.S. Pat. No. 3,893,220 issued July 8, 1975 and the above U.S. Pat. No. 4,004,673 and 3,994,381. Such nose pieces have prevented the requirement of compact contruction from being achieved.

It is a principal object of the present invention to provide an improved dot matrix print head of the ballistic type which achieves the aforementioned requirements to a greater extent than print heads which have previously been proposed.

It is another object of the present invention to provide an improved dot matrix print head which may be fabricated from a minimum number of parts and does not require labor intensive assembly techniques.

It is a further object of the invention to provide an improved dot matrix print head, the parts of which may to a large extent be molded plastic parts of low cost.

It is a still further object of the present invention to provide an improved dot matrix print head in which the armatures or clappers which drive the print wires are guided and mounted in a manner to minimize frictional forces, wear and heating for improved reliability and high printing speed.

It is a still further object of the present invention to provide an improved print head in which the print wires in the linear array which exits the nose of the head are maintained side by side and in sliding relationship with each other without the use of jewel bearings.

It is a still further object of the present invention to provide an improved print head wherein connections are made to the coils in the magnetic actuators thereof without adversely affecting the design or compactness of the head.

Briefly described, a dot matrix print head of the ballistic type which embodies the invention uses a plurality of print wires and has a body containing a nose piece and a coil frame assembly with a plurality of solenoidal coils and armatures. The print wires are disposed in the nose piece and present opposite ends for dot printing and for impact by the armatures to be ballistically driven to dot printing position. Guidance and mounting of the armtures for movement from a return position into impact delivering relationship with the print wires is obtained by spring means which bias the armatures toward the frame and pivotally mount one end of the armatures on the frame. The support structure for the spring means on the frame has a plurality of guide posts disposed in the direction of movement of the armatures. The posts pass through holes in the spring means and in the armatures. The holes have sufficient clearance to enable low friction movement of the armatures back and forth to the return position while maintaining the armatures in alignment with the posts and thereby with the frame, the solenoidal coils and the ends of the print wires on which the armatures impact.

The construction of the nose piece and the assembly of the support and guidance means for the armature enables them to be integrated into a compact structure which can be assembled at low cost.

The foregoing and other features, objects, and advantages of the invention, as well as a presently preferred embodiment, thereof will become more apparent from a reading of the following description in connection with the accompanying drawings in which.

Figure 1:
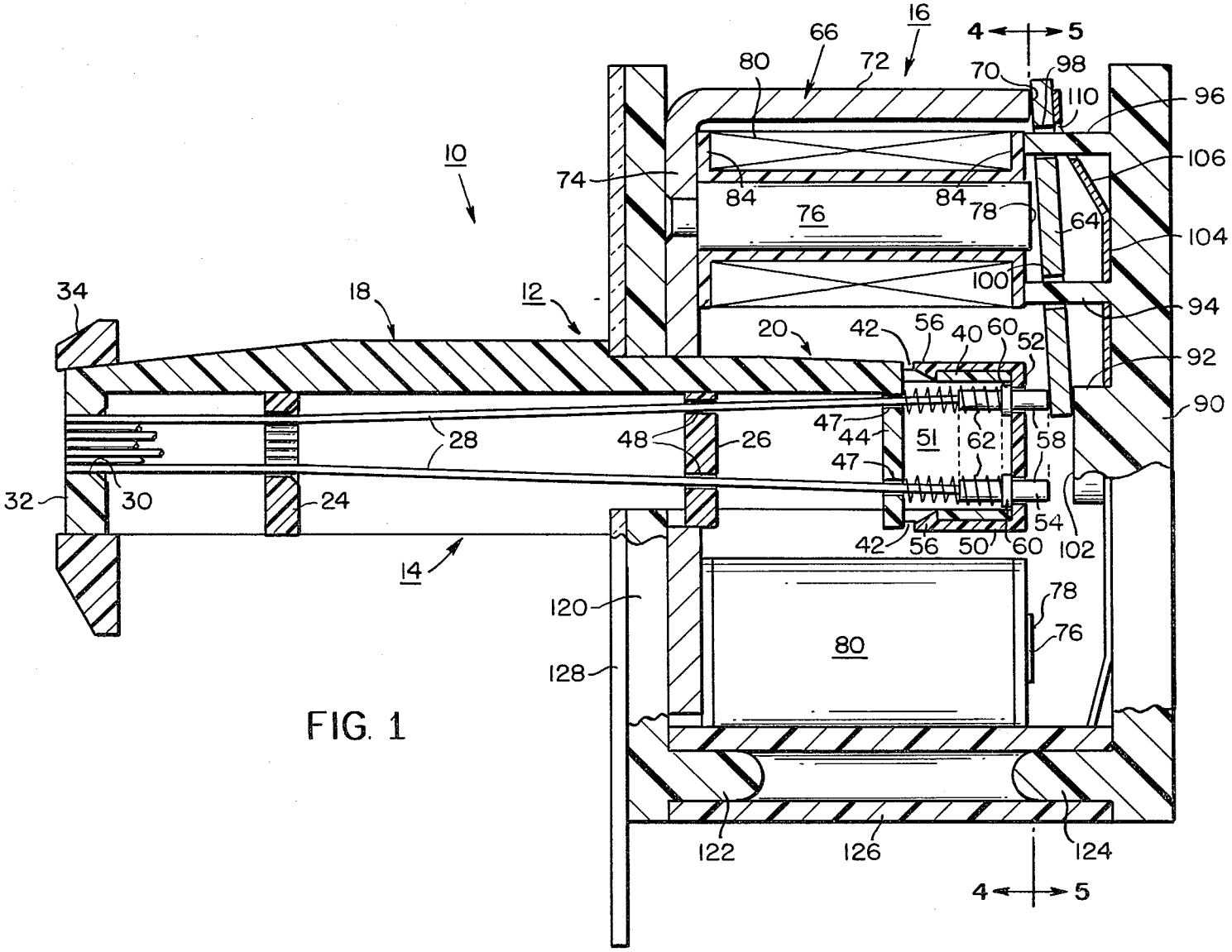
FIG. 1 is a sectional view taken generally along the line 1—1 in FIG. 3 showing a print head embodying the invention.

Referring more particularly to the drawings, there is shown a print head 10 without the carriage block of the printer on which it is mounted. This carriage block is carried by the guideshaft and print head drive mechanism of the printer, also not shown, which may be conventional. By the choice of various carriage blocks, the print head may be adapted for use in various printer mechanisms. The printer also includes electronic circuits, not shown, for applying current to the head to enable it to print on paper, usually computer forms, by impacting a ribbon against the paper.

The head 10 has a body 12 constituted of a nose piece 14 and a coil frame assembly 16. The nose piece 14 like many of the parts of the head 10 are molded of plastic material, preferably a polycarbonate and tetrafluorethylene (Teflon) resin is used. All of the plastic parts of the head 10 may be molded of plastic using the same resin. The polycarbonate and teflon resin may be of the type that is commercially available. The nose piece has a front section 18 and a rear section 20. Slotted horizontally extending flanges 22 and 23 (FIG. 3) on the front section 18 are used to connect the head to the carriage block (not shown) on the printer for traversing the head to print lines of characters on the paper as explained above. The bottom of the nose piece 14 may be open in order to enable the assembly of guides 24 and 26 therein and to facilitate cooling of print wires 28, seven of which are located in the nose piece 14 of the head 10. Head 10 is designed to print characters by a five by seven matrix (seven dots in a column and five in a row). Other matrices may, of course, be used.

A linear row of the print wires 28 extends through a slot 30 at the front end 32 of the nose piece 14. The wires are side by side with their peripheries in sliding relationship in the slot 30. The slot is approximately the same length as the sum of the diameters of the seven print wires with a slight clearance so that the print wires may move freely through the slot out of the front end 32 of the nose piece to printing position where they impact the ribbon on the paper to form columns of dots defining the printed characters. It has been found, in accordance with the invention, that the use of jewel bearings in the front end guide may be eliminated by arranging and guiding the wires through the slot 30. A rectangular frame 34 with tapered ends on the top and bottom thereof serves as a ribbon guide to position the ribbon with respect to the front ends of the print wires 28. This guide may be attached to the front end of the flanges 22 and 23 (see FIGS. 2 and 3).

The print wires themselves may be stainless steel (tempered 302 being suitable). This may be material similar to that used for music or piano wire. The diameter may be fourteen thousandths of an inch as in conventional dot matrix print heads. However, because the wires are adjacent to each other at the front end 32 of the nose piece where they contact the ribbon and paper, the printed dots are also closely adjacent to each other. This provides more continuous printing of the characters and improved printing quality.

Figure 2:
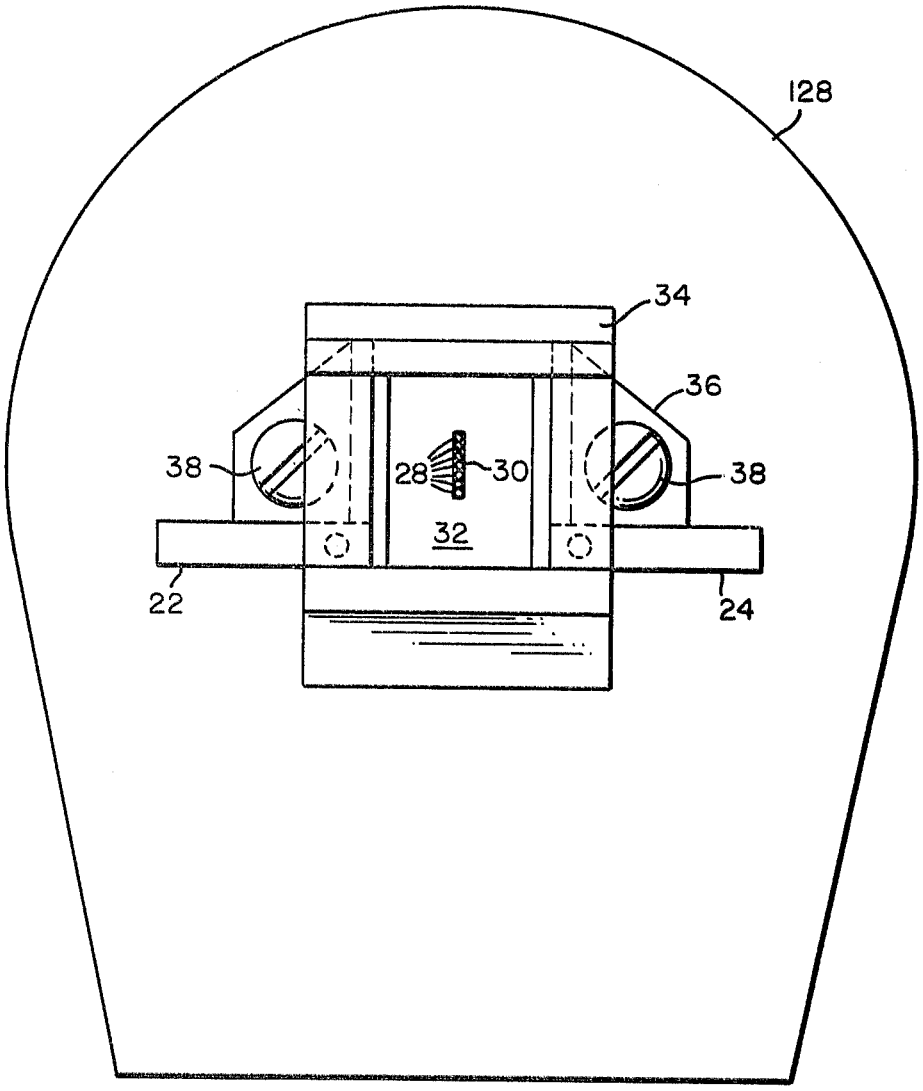
FIG. 2 is an end view of the print head shown in FIG. 1.
Figure 3:
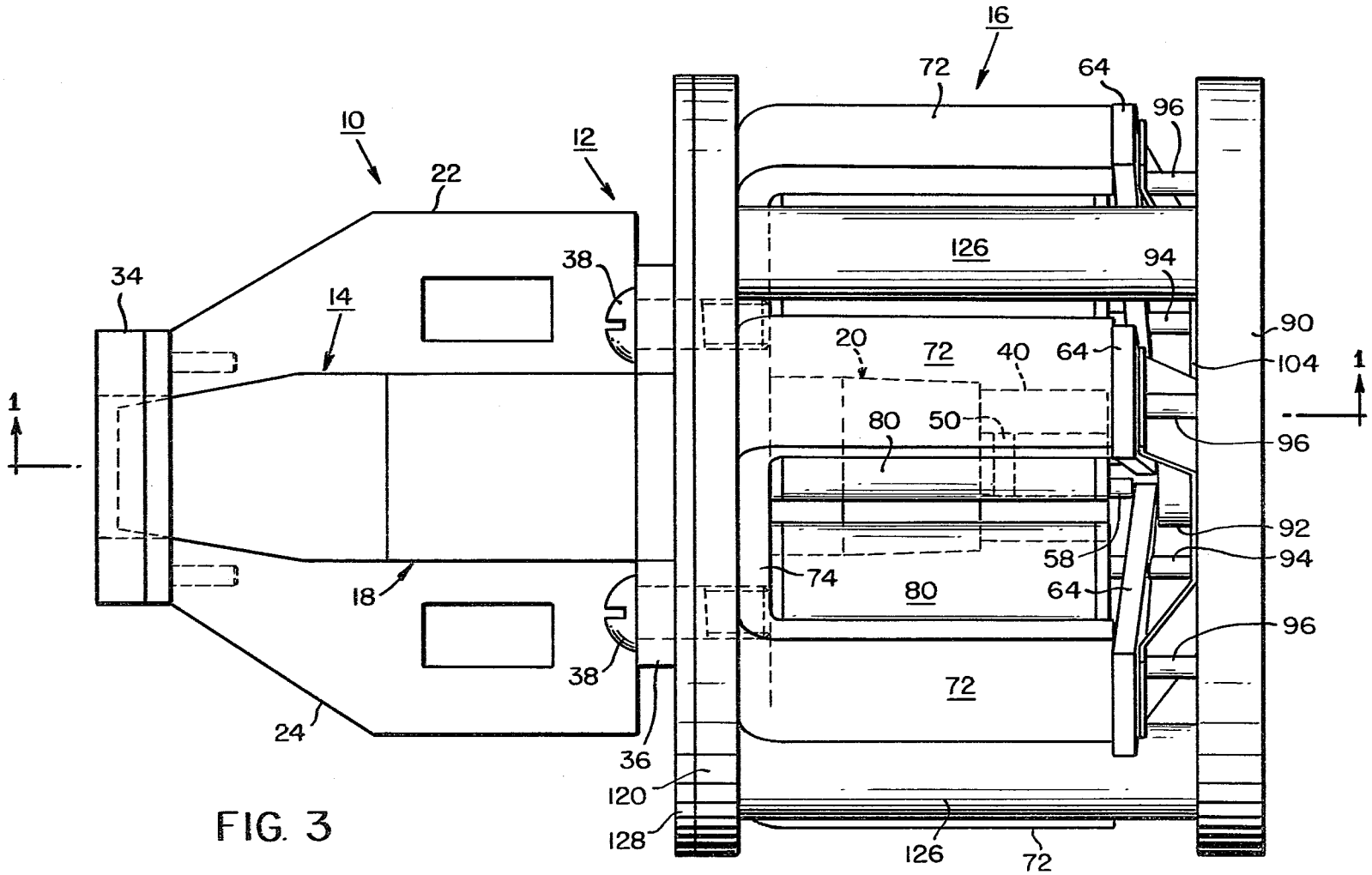
FIG. 3 is a plan view of the print head shown in FIG. 1.

The nose piece also has a vertical flange 36, (see FIGS. 2 and 3). Bolts 38 extend through the flange 36 into the coil frame assembly to fixedly attach the nose piece 14 and the frame assembly 16. The rear section 20 of the nose piece has an open-ended cylindrical portion 40 with diametrically opposite slots 42. Adjacent to the cylindrical portion toward the front of the nose piece is a rear guide 44 having an array of seven holes in a slight elliptical configuration about the longitudinal axis of the nose piece. The print wires 28 extend through these holes, which have sufficient clearance, to allow the movement of the print wires between their printing and return positions. The next guide 26 has a more eliptical array of holes 48. The wires 28 are bent toward the linear straight line array as they pass through the holes 48 in the guide 26. The guide 24 which is closest to the front end 32 of the nose piece 14 has holes 50 which are already in a straight line array but are spaced somewhat farther apart than the diameters of the wires 28. The location of the guides 24 and 26 is selected to bend the wires gradually from the circular position at the rear end of the nose piece 14 to the straight line side by side position at the front end 32 thereof. The intermediate guides 24 and 26 may be separately molded and press fit into the nose piece 14.

A spring clip closure plate 50 having a disk 52 with an array of holes 54 in a circle around the longitudinal axis of the nose piece 14 closes the rear end of the nose piece and defines a region 51 between the guide 44 and the disk 52 of the clip 50. Hookend fingers 56, which latch on the edges of the slots 42, hold the spring clip 50 in place. End caps 58 having collars 60 are disposed on the rear ends of the print wires 28. It is preferred that the end caps be of brass or steel. The material chosen depends upon the mass-spring characteristics of the system to maximize the transmission of forces by impact and to minimize vibration. The print wires are biased to return position by return springs 62 in the region 51 of the nose piece 14. The springs bear upon the end guide plate 44 and the collars 60 of the end caps 58.

Figure 6:
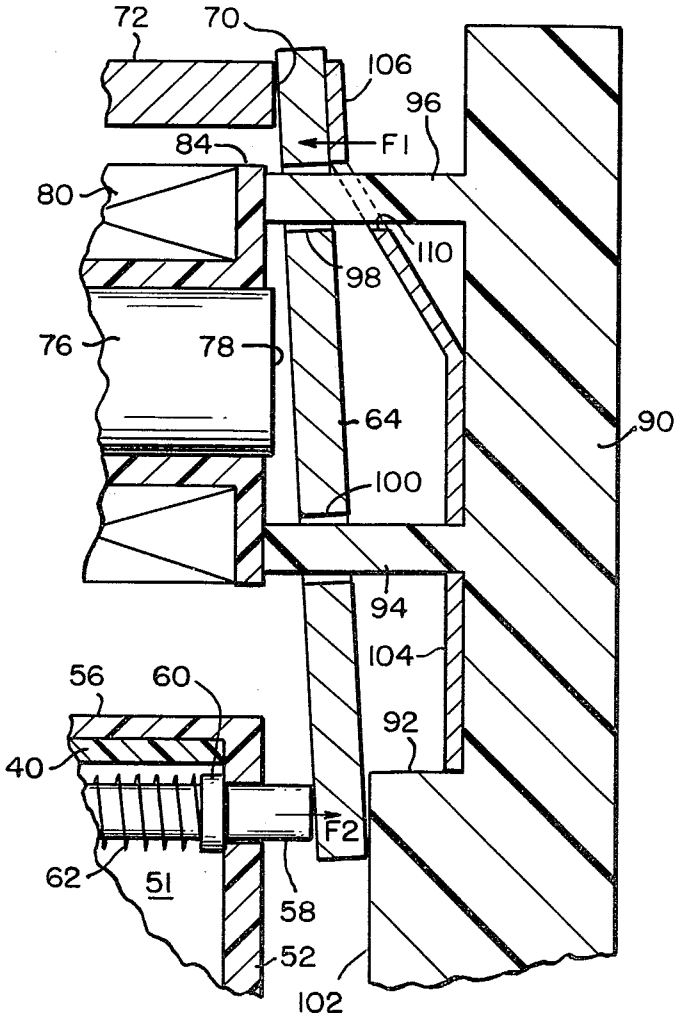
FIG. 6 is an enlarged, fragmentary sectional view of a portion of FIG. 1 showing one of the armatures, the frame assembly and print wire on which it bears and the mechanism for supporting and guiding the armature while at the same time facilitating the assembly of the print head.

The collars 60 and clip closure plate 50 set the return position of the print wires 28. These print wires are impacted by armatures 64 which are triangular pieces of magnetic material, suitably cold rolled steel with a nickel flashing or plating for corrosion resistance. The armatures are radially arranged in an array complementary to the circular array of print wires extending from the rear end of the nose piece 14. Areas adjacent to the apex of each armature on the inside surface thereof are disposed on the rear ends of the print wires 28 and their end caps 58, which are flush as shown in FIG. 6. The base ends of the armatures 64 rest on the frame 66 of the frame assembly 16, and particularly on the end surfaces 70 of fingers 72 which extend rearwardly from the base 74 of the frame 66. The frame 66 itself is of magnetic material, preferably cold rolled steel, flashed or plated with nickel for corrosion resistance. A plurality of posts 76 equal in number to the number of print wires 28 are attached, preferably by staking them in holes in the base 74. The posts 76 are in a circular array complementary to the circular array of the rear ends of the print wires 28. These posts are also of magnetic material and may be nickel flashed or plated with the frame 66 as an assembly. The posts 76 form the cores or poles of the solenoidal coils 80 which actuate the armatures 64. The end surfaces 78 of the posts are spaced from the inside surfaces of the armatures by air gap when the armatures are in return position. In the forward position, the inside surfaces of the armatures bear against the ends 78 of the posts 76.

Figure 4:
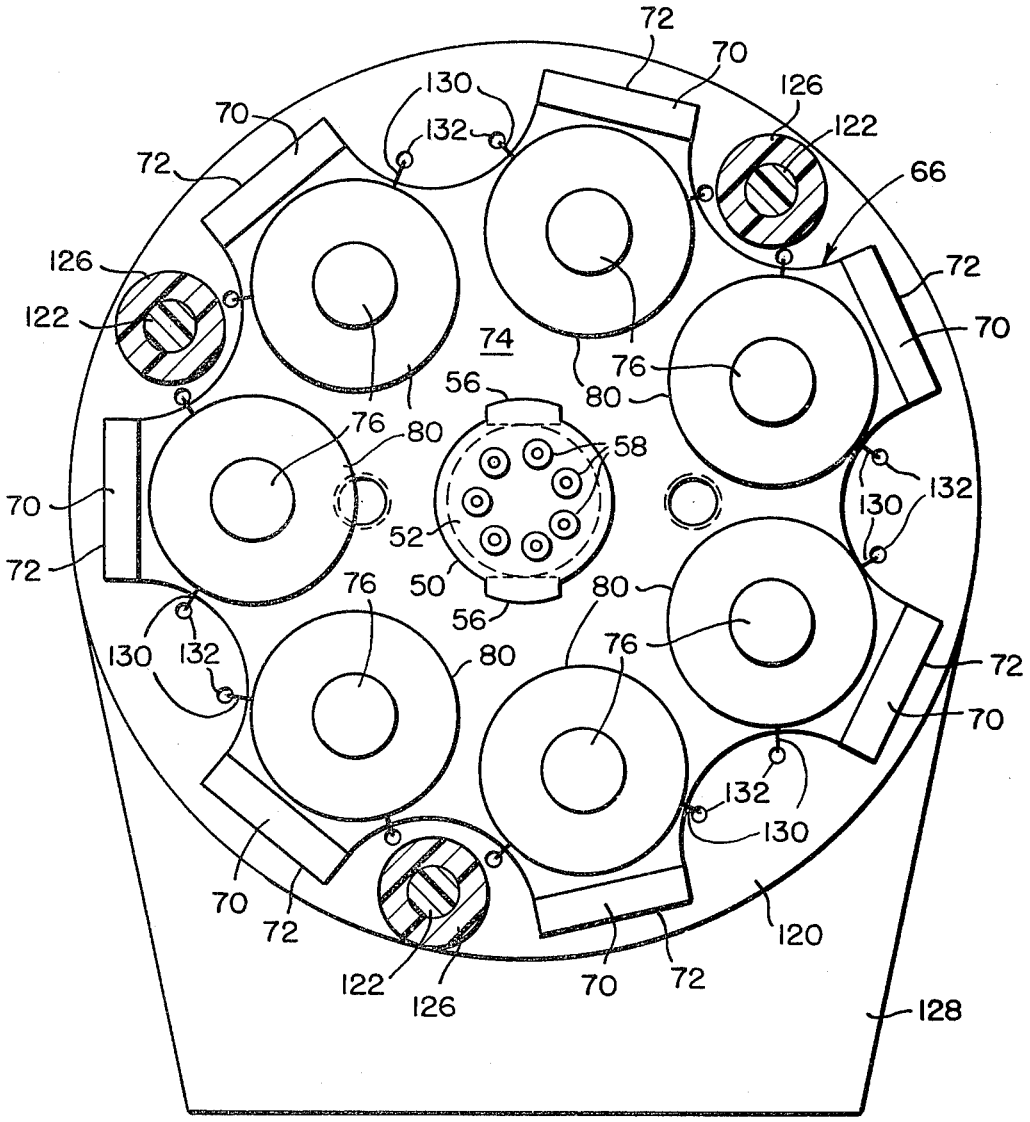
FIG. 4 is a sectional view of the print head shown in FIG. 1, the section being taken through the rear thereof in the direction of the arrows 4—4.
Figure 5:
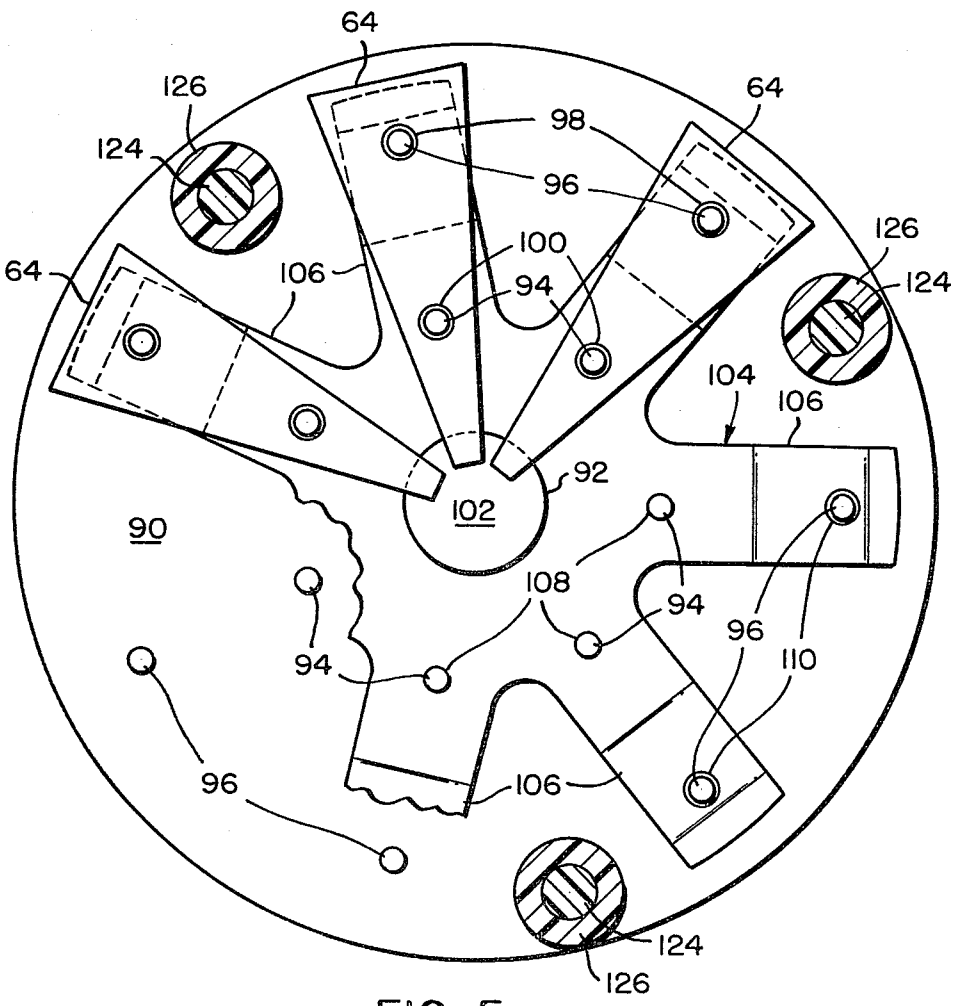
FIG. 5 is another sectional view through the rear of the print head shown in FIG. 1 but in the opposite direction to the section shown in FIG. 4 as indicated by the arrows 5—5 in FIG. 1.

It will be seen, especially from FIGS. 4 and 5, that the centers of the posts 76, the centers of the end surfaces 70 of the fingers 72 and the bisectors of the triangular armatures 64 are all along radial lines through the longitudinal axis of the nose piece, which is the center of the circle along which the rear ends of the print wires 28 are arrayed. The print wire rear ends are also disposed along these radial lines. The radial lines are angularly spaced from each other by 360° divided by the number of print wires used in the head. In the illustrated head, which uses seven print wires, these radial lines are exactly 51° 25′ and 30″ apart.

The solenoidal coils 80 are wound on bobbins 82 having end flanges 84. The bobbins may be of nonmagnetic material such as plastic (suitably nylon). The frame 66 may be considered to be the yoke of the magnetic structure with the fingers 72 and the posts 76 providing the poles for the armatures 64. The entire assembly 16 is considered to be the coil frame assembly, and includes the yoke 66 and the other parts which provide the means for supporting and mounting the armatures 64 about the rear section 20 of the nose piece 18.

The support and guidance for the armature enables it to be separate and detached from the other components of the coil frame assembly, while at the same time being moveably disposed in alignment with poles 70 and 78 of the magnetic structure and the rear ends of the print wires 28. This supporting and guiding means is provided by a rear end cap 90, which is a disk of the same plastic material as used for the nose piece 18. A center post 92 extends from the inside surface of the disk. Two circular arrays of guide posts 94 and 96 also extend from the inside surface of the end cap 90. These guide posts 94 and 96 are arranged along radial lines through the axis of the end cap 90 which are angularly spaced complementary to the radial lines along which the bisectors of the armatures 64 and the rear ends of the print wires 28 are disposed.

The armatures 64 have holes 98 and 100 (see especially FIG. 5) through which the posts 96 and 94 extend. The ends of these posts bear against the flanges 84 of the coil bobbins 92 so as to set the spacing between the inside surface of the end cap and the frame 66, taking into account, of course, the thickness of the armatures 64. The surface 102 of the center post 92 functions as a stop for the armatures 64. The holes 98 and 100 are large enough to permit the armatures 64 to be guided as they are moved with minimal frictional contact forces.

Spring means in the form of a spider spring 104 (see FIGS. 1 and 5) serves to retain the armatures in place on the frame 66. The center of the spring 104 fits around the post 102 of the end cap and the center and part of the arms 106 of the spider spring 104 bear against the inside surface of the rear end cap 90. The spider spring 104 also has holes 108 and 110 which are arranged in circular arrays. The posts 94 and 96 extend through these holes 108 and 110 and maintain the arms 106 of the spider spring 104 in alignment with the armatures 64. The outer end surfaces of the arms 106 of the spider spring 104 bear against the armatures opposite to the areas of the armatures which are disposed on the end surfaces 70 of the fingers 72 of the frame 66.

As will be observed more clearly in FIG. 6, the armatures are pivotally mounted on the end surfaces 70. The ends of the arms 106, however, bear over a contact area to the inside of the pivot, that is towards the print wires 28. Accordingly, a bias force indicated in FIG. 6 as F1 is developed which tends to oppose the return spring bias force, indicated as F2. The force of the retaining spider spring 106 counterbalances the force of the return springs and sets the armatures in a return position close to the poles provided by the ends 78 of the solenoid coil posts 76. The electromagnetic actuation forces are thereby reduced. Consequently, the drive current for the coils 80 can be reduced, requiring less current and reducing heating (increasing the thermal efficiency) of the print head.

The coil frame assembly 16 is completed through the use of a front end cap 120 which is also a disk of plastic material similar to that used for the other plastic parts of the head. Three posts 122 on the front end cap 120 are spaced apart so that they will fit in the spaces of the base 74 between the fingers 72 of the frame 66 (see FIG. 4). Similar posts 124, which are in alignment with the posts 122, extend from the inside surface of the rear end cap 90 (see FIG. 5). Tubes 126, which are desirably of the same plastic material as used for the end caps 90 and 120, receive the posts 122 and 124 in press fit relationship. Accordingly, the assembly of the coil frame assembly may be carried out with minimal labor by arranging the spider spring 104 and the armatures on the posts 94 and 96 and press fitting the end caps 90 and 120 together on the tubes 126 to clamp the coil frame 160 with the solenoidal coils between the end caps 90 and 92.

A printed circuit board 128 contains connections for the leads 130 of the coils 80 to the actuating circuits. A connector (not shown) may be located, for example on the lower edge of the circuit board 128. The front end cap 120 is provided with holes 132. The leads 130 are brought forth through these holes and connected to the printed circuit board. The printed circuit board also acts as a heat sink or thermal dissipater. If desired, another metal plate or fin may be placed between the board 128 and the end cap 120 to facilitate heat dissipation. The thermal efficiency of the print head 10 is therefore high and the print head may operate at very high speeds, for example, in excess of 250 characters per second without generating heat to an extent significant to effect the performance thereof.

The bolts 38 extend through the flange 36 and aligned holes in the printed circuit board 128 and front end cap 120 into tapped holes in the base 74 of the frame 66. The bolts 38 secure the nose piece 18 to the coil frame assembly 16.

From the foregoing description it will be apparent that there has been provided an improved dot matrix impact print head. Variations and modifications in the herein described print head which use the features of the invention and are within the scope thereof, will undoubtedly support themselves to those skilled in the art of designing and manufacturing print heads. Accordingly, the foregoing description should be taken as illustrative, and not in a limiting sense.

I claim:

1. A dot print head of the ballistic type which comprises a plurality of print wires, a body having a nose piece with a coil frame assembly having a yoke with a plurality of solenoidal coils and armatures, said print wires being disposed in said nose piece and presenting opposite ends thereof for dot printing and for impact by said armatures to be ballistically driven to dot printing position, said body having means for guiding and mounting said armatures for movement between positions in impact delivery relationship with said print wires and return positions, said guiding and mounting means including spring means biasing said armatures towards said yoke and a support structure for said spring means on said frame assembly, said structure having a plurality of stationary guide posts disposed in the direction of movement of said armatures between said impact delivery and return positions, and openings in said armatures in alignment with said posts and through which said posts extend with spacing between said armature openings and said posts in guiding and assembled relationship with said armatures.

2. The print head according to claim 1 wherein said spring means is a spider spring having a plurality of arms, each in alignment with a different one of said armatures, said arms having openings therein in alignment with said posts, said posts extending through said openings in said spider spring arms and through said armature openings.

3. The print head according to claim 2 wherein said armature openings and spider spring arm openings are holes, said holes being bigger than the posts which extend therethrough to provide clearance for movement of said spring arms and armatures between said impact delivery and return positions.

4. The print head according to claim 1 further comprising a cap upon the rear end of said body which is opposite to the front end of said nose piece through which said wires are driven to dot printing position by said armatures, said posts extending from said cap, said spring means bearing against said end cap and said armatures near one of the ends thereof.

5. The print head according to claim 4 wherein said spring means is a spider spring is separate and detached from said armatures and said rear end cap, said armatures also being separate and detached from said yoke, rear end cap and other parts of said coil frame assembly.

6. The print head according to claim 5 wherein said posts space said rear end cap and said yoke from each other to provide a region therebetween containing said separate and detached armatures and spring means.

7. The print head according to claim 6 wherein said nose piece has a rear end, return springs in said rear end for biasing the rear ones of said opposite ends of said print wires against surfaces of said armatures adjacent the inside ends thereof, while said outside ends of said armatures are biased against said yoke by said spider springs to yieldably mount said separate and detached armatures and spider springs in said region between said yoke and rear cap.

8. The print head according to claim 7 wherein said yoke has a plurality of posts each in alignment with a different one of said armatures, each of said posts being disposed between said rear end of said nose piece and the outside of said yoke to provide magnetic structures, and wherein said solenoidal coils comprised bobbins having flanges with coils of wire thereon on said magnetic structure posts, said posts on said rear end bearing upon said flanges to space said rear end from said yoke to define said region.

9. The print head according to claim 8 further comprising a front cap, said yoke, armatures and spider spring being disposed between said front cap and said rear cap, a plurality of posts attaching said front cap and rear end cap to each other to retain said yoke, solenoidal coils, armatures, and spider spring in assembled relationship clamped between said front and rear end caps.

10. The print head according to claim 9 further comprising a printed circuit board disposed in side by side relationship with said front cap, openings in said front cap, and lead wires from said coils extending through said holes in said front cap and being connected to said printed circuit board.

11. The print head according to claim 10 wherein the forward end of said nose piece has a flange thereon which is adjacent to said printed circuit board, aligned holes in said board, front cap and yoke, said holes in said yoke being threaded and screw means extending into said aligned holes for assemblying said nose piece and frame assembly to provide said body with said board, front and rear end caps in assembled relationship.

12. The print head according to claim 1 wherein the rear end of said nose piece is open and has a guide plate spaced inwardly from said rear end, said guide plate having holes for said wires for guiding them toward the front end of said nose piece, caps on said wires having collars thereon, return springs around said wires disposed between said guide plate and said collars and bearing thereagainst, said rear end of said nose piece having openings in the sides thereof, a closure plate having holes therethrough for the portions of said wire caps rearward of said collars thereof, spring fingers having hooks at the ends thereof extending forwardly of said plate into latched relationship with said nose piece rear end openings.

13. The print head according to claim 12 wherein said wires extend through said caps to bring the rear ends thereof flush with the ends of said caps.

14. The print head according to claim 1 wherein said yoke is of magnetic material providing a magnetic structure with a base and a plurality of fingers extending rearwardly from said base in a direction longitudinally of said nose piece, said fingers having end surfaces, said magnetic structure also including a plurality of posts connected at one end thereof to said yoke base and also extending longitudinally and being spaced from said fingers along lines between the rear ones of said opposite ends of said wires and said fingers, said armatures having opposite ends and sides, surfaces near the opposite ends of said armatures on one side thereof being freely disposed on said end surfaces of said fingers and said rear ends of said wires, said spring means bearing upon the other of said opposite sides of said armatures in surface areas thereof opposite to the areas of the surfaces disposed on said end surfaces of said fingers to pivotally mount said armatures on said frame, said armatures being spaced from the ends of said posts of said magnetic structure opposite to said one end of said posts when said armatures are in said return position.

15. The print head according to claim 14 wherein said armatures are flat plates the sides of which define triangles having bases at said end thereof on said end surfaces of said fingers and apexes near the ends thereof on said rear ends of said wires.

16. The print head according to claim 15 comprising return springs on said wires for biasing said wires and armatures toward said return position, said spring means bearing against said other of said opposite sides of said armatures between the pivot and said end of said armatures adjacent to said wires to bias said armatures away from said return position to partially balance the bias of said return springs and narrow the gap between said other ends of said posts of said magnetic structure and said armatures.

17. The print head according to claim 1 wherein said nose piece has a plurality of guides therein having openings for said wires to guide said wires from an array around the longitudinal axis of said nose piece at the rear one of the opposite ends thereof to a linear array with said wires in juxtaposition and sliding relationship with each other along the peripheries thereof at the front end of said nose piece, said front end having a guide with a slot therein equal in length to the sum of the diameters of said wires to enable said wires to selectively slide with respect to each other forwardly from said nose piece to impact printing position.

18. A dot matrix print head of the ballistic type which comprises a plurality of wires, a body having a nose piece with a frame assembly with a frame, said wires being disposed in said nose piece and extending through an end thereof with the ends of said wires disposed in an array about the axis of said nose piece, a plurality of solenoids in said frame assembly disposed in an array complementary to said array of said ends of said print wires, said solenoids having a plurality of armatures radially disposed in an array complementary to said solenoid array, surfaces near opposite ends of said armatures on the same side thereof being disposed upon said frame and said ends of said print wires, means in said frame assembly for retaining said armatures for reciprocal movement away from and back to a return position to drive said wires outwardly through the end of said nose piece opposite from said first named nose piece end, return springs for biasing said wires and the end surfaces of said armatures thereon towards said return position, and said retaining means including retaining springs means bearing upon end surfaces of said armatures on the opposite side of each of said armatures opposite to said end surfaces which are disposed on said frame for biasing said armatures in a direction opposite to said return springs to partially balance the bias of said return springs to locate said armatures in said return position.

19. The dot matrix print head according to claim 18 wherein said armatures are pivotally mounted on said frame, said retaining spring means bearing on said opposite side of said armatures inside of the pivots toward said print wire ends.

20. The dot matrix print head according to claim 19 wherein said frame assembly comprises a cap having an inside surface opposite to said array of armatures and spaced therefrom, said inside surface having a central post presenting a surface providing a stop for the ends of said armatures which are disposed upon said print wire ends in said end array.

21. The dot matrix print head according to claim 20, wherein said retaining spring means is a spider spring having arms disposed in an array complementary to said armature array, radially outward end portions of said arms bearing upon said sides of said armatures opposite to the end surfaces thereof which are disposed on said frame, said spider springs having a central portion bearing on said cap surface around said center post and said arms of said spider spring being bent between said end portions thereof which bear on said armatures and said center portion thereof.

22. The dot matrix print head according to claim 19 wherein said solenoids have a magnetic structure including a yoke provided by said frame, said yoke having sides defining the outside of said frame, poles of said magnetic structure being posts inside said yoke, coils around one of said sides and said posts, said yokes having ends on which each of said armatures are pivotally disposed and retained by said retaining spider spring arms, said posts of said magnetic structure being spaced from said armatures to define gaps therebetween when said armatures are in said return position and providing stops for said armatures when said armatures reach the end of their reciprocal movement away from said return position.

23. A dot matrix print head comprising a plurality of print wires, a body including a nose piece in which said said wires are disposed and a coil frame assembly with solenoidal coils, a plurality of armatures actuated by said coils for driving said wires between return and dot printing positions, means for moveably mounting said armatures on said coil frame assembly, first and second end cap plates spaced from each other on opposite sides of said coil frame assembly and secured to each other for holding said armatures with said mounting means and said frame assembly in assembled relationship, said nose piece extending through said first end cap plate toward the front end of said nose piece through which said wires move into said dot printing position, a printed circuit board on said first end cap in side by side relationship therewith, openings in said first end cap, wires from said coils extending through said first end cap and connected to said board, a plurality of tubes, a plurality of posts shorter than said tubes on opposite sides of said first and second end cap plates and aligned with other, said posts being disposed in press fit relationship in opposite ends of said tubes.

24. The print head according to claim 23 wherein said coil frame assembly has a yoke, said armatures are freely disposed on said yoke of said coil frame assembly and on said print wires near opposite ends of said armatures, said mounting means comprising said second end cap, and a flat, bent spring bearing against said armatures and said second end cap.

* * * * *